United States Patent [19]

Suzuki et al.

[11] Patent Number: 4,660,714

[45] Date of Patent: Apr. 28, 1987

[54] SAFETY GAS CONTAINER

[75] Inventors: Kenji Suzuki, Izumishi; Yoshinori Ito, Iwatsukishi, both of Japan

[73] Assignee: Kabushiki Kaisha Asahi Seisakusho, Saitamaken, Japan

[21] Appl. No.: 837,761

[22] Filed: Mar. 10, 1986

[30] Foreign Application Priority Data

May 14, 1985 [JP] Japan ..... 60-102300

[51] Int. Cl.[4] ..... F17C 1/14

[52] U.S. Cl. ..... 206/0.6; 220/3; 220/367; 137/79

[58] Field of Search ..... 220/3, 202, 361, 367, 220/66; 206/0.6; 137/79

[56] References Cited

U.S. PATENT DOCUMENTS

| | | | |
|---|---|---|---|
| 771,813 | 10/1904 | Crocker | 220/3 X |
| 1,420,721 | 6/1922 | McNiff | 220/3 |
| 2,743,841 | 5/1956 | Bügel | 220/367 X |
| 3,380,620 | 4/1968 | Dean | 220/367 |
| 4,006,838 | 2/1977 | Baumann et al. | 220/3 |
| 4,026,512 | 5/1977 | Holt | 220/367 X |
| 4,219,126 | 8/1980 | Oana . | |

*Primary Examiner*—Steven M. Pollard

*Attorney, Agent, or Firm*—Schwartz, Jeffery, Schwaab, Mack, Blumenthal & Evans

[57] ABSTRACT

A safety gas container including a valve member made of a shape memory alloy, the valve member having a top head and a bottom head with a stem portion having a relatively small diameter therebetween; wherein the valve member is fitted in a gas passageway of the container; wherein the shape memory alloy is previously made to remember a smaller shape at a specific temperature; and whereby the valve member is diminished in size in response to a rise in the ambient temperature above the specific temperature so that gaps occurs between the valve member and the inside wall of the gas passageway.

8 Claims, 6 Drawing Figures

SAFETY GAS CONTAINER

BACKGROUND OF THE INVENTION

1. Field of the Invention

The present invention relates to a safety gas container and more particularly, a safety gas container for holding a gas of explosive nature, such as carbon dioxide gas, oxygen and a liquefied fuel gas, the container being provided with a valve for permitting the content to escape at such a small rate as to avoid an abrupt ejection of the content which would cause a reaction on the container thereby to propel it forward.

2. Description of the Prior Art

A typical example is disclosed in U.S. Pat. No. 4,219,126. The disclosed container is provided with a recess in the sealing plate, the recess having a thin bottom wall rupturable under the rise in internal pressure due to overheating. The disclosure teaches that when the internal pressure abnormally rises an invisible crack occurs in the bottom of the recess, through which the content gradually leaks thereby to reduce the internal pressure.

As a result of experiments, however, it has been found out that the crack develops from the bottom to the inside wall of the recess, thereby finally causing the whole recess to rupture into a hole. Consequently the content ejects through the hole, thereby causing the reaction of ejection upon the container. It is reported that there have been several accidents in which people were injured by the flying container. This is mainly caused by the structure in which the gas is straightly ejected along the axis of the container. It is therefore difficult to prevent the container from flying under the reaction.

Another disadvantage of the disclosed invention is that it is difficult to equalize the bottom thicknesses of the recesses. Normally the bottom wall is made as thin as 0.3 mm so that it readily fructures under the rise in internal pressure. As a result it is unavoidable that some containers have recess whose bottom walls are relatively thick while others have those which have relatively thin bottom walls. Thus the safety critical temperature has to be low.

A further disadvantage of the prior invention is that the thin bottom walls of the recesses are liable to corrosion because of a gathering water, such as rain. The corroded bottom is likely to fracture even at normal pressures.

OBJECTS AND SUMMARY OF THE INVENTION

The present invention is directed to solve the problems pointed out above, and has for its object to provide a gas container which allows the content to escape at such a small rate as to avoid propelling of the container under the reaction.

Another object of the present invention is to provide a gas container having a high and wide thermal safety range.

A further object of the present invention is to provide a gas container capable of easy and economical construction.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided a safety gas container comprising:

a valve member made of a shape memory alloy, the valve member having a top head and a bottom head with a stem portion having a relatively small diameter therebetween;

wherein the valve member is fitted in a gas passageway of the container;

wherein the shape memory alloy is previously made to remember a smaller shape at a specific temperature; and whereby the valve member is diminished in size in response to a rise in the ambient temperature above the specific temperature so that gaps occurs between the valve member and the inside wall of the gas passageway.

DETAILED DESCRIPTION OF THE INVENTION

Figure 3:
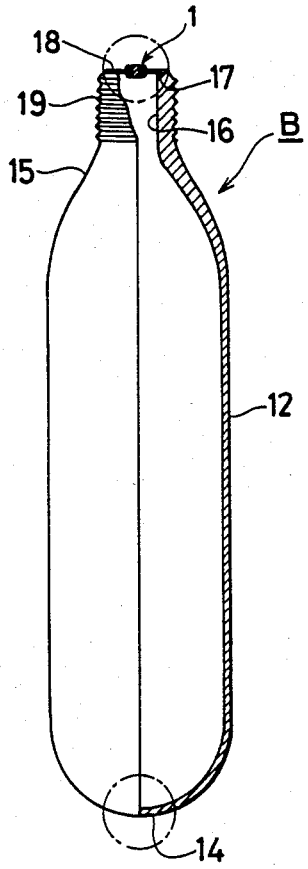
FIG. 3 is a partial cross-sectional view showing a gas container according to the present invention.

FIG. 3 shows a typical cylinder type gas container usually having a length of about 130 mm and a wall thickness of 1.8 mm on average. The body portion is indicated by 12, which has a bottom portion 14 of a hemispheric shape. The container has a round shoulder portion 15 and a neck portion having threads 19 in which a gas passageway 16 is produced.

After a gas (e.g. a liquefied carbon dioxide gas) has been filled in the container, a sealing plate 18 is welded to the outer peripheral edge of the gas passageway 16 thereby to close it. The sealing plate 18 has a thickness of about 0.3 mm and has an aperture 5 adapted to allow the content to escape therethrough. The aperture 5 is closed by a valve member 1, which includes a body 2, a stem portion 3 and a head portion 4. The valve member 1 itself is made of a shape-memory-alloy, hereinafter referred to the SM alloy. The valve member 1 is fitted in the aperture 5.

The SM alloys mean all alloys which are capable of remembering their original shapes by virture of martensite transformation. These alloys have the ability of restoring their original shapes when they are heated above a specific temperature $T_o$. A Ni-Ti content alloy, Cu content alloy, Ag-Cd content alloy, In-Tl content alloy,, Fe-Pt content alloy and others fall in the category of the SM alloys, and can be used for making the valve member 1. However, when the relatively favourable characteristics of recovery and fatigue are taken into consideration, the Ni-Ti content alloys are preferred. On the other hand, when the relatively cheap price is taken into account, the Cu content alloys, such as Cu-Al, Cu-Al-Ni content alloys, are preferred.

The SM alloys herein are not limited to those which are capable of unidirectional shape recovery, but include those which are capable of repeating the shape recovery in response to changes in temperatures.

The Cu content SM alloys includes those which are especially swageable, and which are adapted for use as a valve by utilizing the unidirectional shape memory characteristics.

In the present invention a specific temperature $T_o$, such as 70° C. for $CO_2$ gas, is set as a thermal safety limit below which the content is safe from an abnormal expansion. Then the amount of Ti against Ni is adjusted so that at this safety temperature a specific shape is remembered, thereby obtaining a bidirectional shape restorable Ni-Ti content alloy.

The alloy obtained is cut to such a length and size that the cut piece is allowed to fit in the aperture 5 in the sealing plate 18, and then the head portions 4 are swaged. In this way the valve member 1 is anchored in the sealing plate 18. As seen from FIG. 1, the valve member 1 has a T-shaped crosssection. The aperture 5 is air-tightly closed by the double enclosure provided by the stem portion 3 and the head portions 4, which are kept in close contact with the top surfaces 8 and the bottom surfaces 7 of the sealing plate 18.

Figure 1:
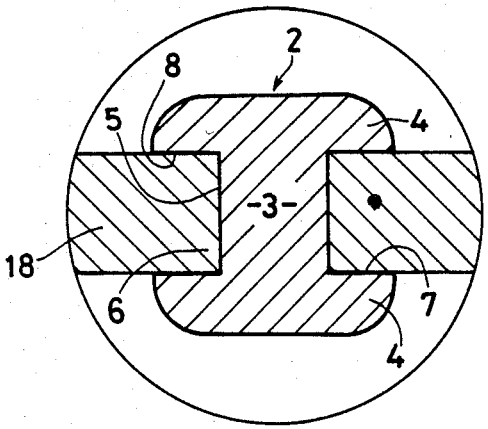
FIG. 1 is a cross-section on a larger scale showing a safety valve portion of the gas container according to the present invention.

Under this arrangement the valve member 1 functions as a plug so long as the container is placed at normal temperatures, as shown in FIG. 1. When the internal temperature rises for some reason or other; for example, when the container is placed in the sunlight for a long time or when a fire breaks out near the container, thereby causing the temperature to rise up to the prescribed temperature $T_o$ (e.g. 70° C.), the valve member 1 is likely to deform in response to the rise in temperature under its shape restoration tendency.

Figure 2:
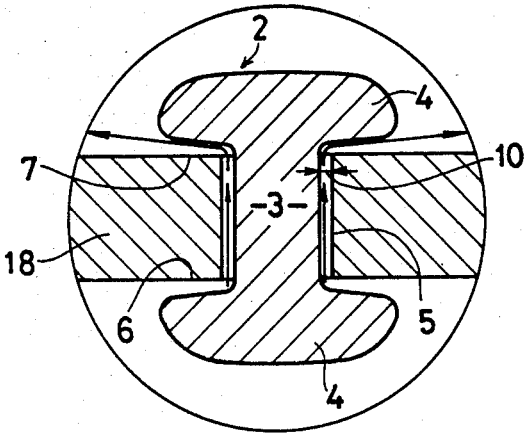
FIG. 2 is a cross-section on a larger scale showing the safety valve of FIG. 1 when in operation in response to the rise in the internal pressure.

As a result the valve memebr 1 diminishes in size as shown in FIG. 2, thereby enabling gaps to occur round the stem portion 3 and between the top and bottom surfaces 7, 8 of the sealing plate 18, and the head portions 4. The reference numeral 10 designates a ring-shaped gap occurring around the stem portion 3, through which the content is allowed to escape. The gap 10 is as narrow as below 1/10 mm, thereby enabling the content to discharge at such a small rate as to prevent the container from propelling under the reaction. In addition, the direction of discharge is horizontal or perpendicular to the axis of the container as shown in FIG. 2.

Figure 4:
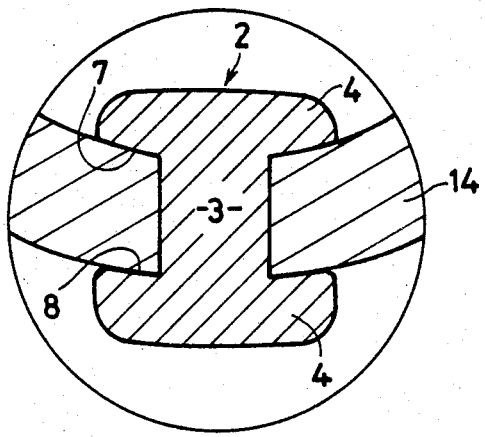
FIG. 4 is a cross-section on a larger scale showing a modified version of the embodiment.
Figure 6:
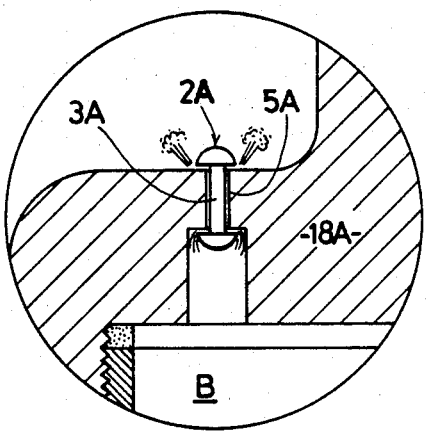
FIG. 6 is a cross-sectional view on a larger scale showing the safety valve of FIG. 5 when in operation in response to the rise in the internal pressure.

FIG. 4 shows another example characterized in that the valve member 1 is fixed to the bottom of the container.

Figure 5:
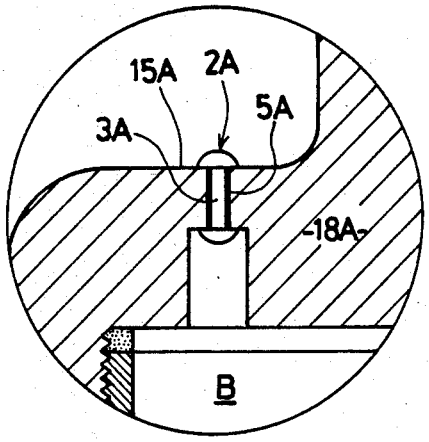
FIG. 5 is a cross-section on a larger scale showing a further modified version of the embodiment.

FIG. 5 shows a further modified version of the embodiment, characterised in that the valve member 1 is fixed to a shoulder 15A of a main valve body 18A screwed to the open end portion of the container. The reference numeral 2A designates a valve member fitted in a pressure escape passageway 5A produced in the main valve 18A. The valve member 2A is also made of a shape-memory-alloy, and in this example it is a elongated bar whose top and bottom head portions are swaged so that the valve member 2A is air-tightly fitted in the pressure escape passageway 5A. When the internal temperature rises up above the prescribed thermal limit, the valve member 2A expands along its length, thereby causing its stem portion 3A to diminish in diameter. Thus the content is allowed to discharged at a small rate through the gap between the stem portion 3A and the inside wall of the pressure escape passageway.

As a further example the valve member can be fixed to the shoulder portion 15 of the container.

As described above, the SM alloys are not limited but can be selected in the wide range of alloys having the shape restoration characteristics.

The gas containers include all kinds of containers for holding thermally expansible gases.

What is claimed is:

1. A safety gas container permitting the content to escape at an abnormally elevated temperature, the container comprising:

a valve member made of a shape memory alloy, the valve member having a top head and a bottom head with a stem portion having a relatively small diameter therebetween;

wherein the valve member is fitted in a gas passage way of the container;

wherein the shape memory alloy is previously made to remember a smaller shape at a specific temperature; and whereby the valve member is diminished in size in response to a rise in the ambient temperature above the specific temperature so that gaps occur between the valve member and the inside wall of the gas passageway.

2. A safety gas container as set forth in claim 1, wherein the shape memory alloy is capable of bidirectional shape recovery in response to changes in temperatures.

3. A safety gas container as set forth in claim 1, wherein the shape memory alloy is capable of unidirectional shape recovery.

4. A safety gas container as set forth in claim 1, wherein the valve member is fitted in a gas passageway produced in a sealing plate placed on the gas passageway of the container.

5. A safety gas container as set forth in claim 1, wherein the valve member is fitted in a gas passageway produced in a shoulder portion of the container.

6. A safety gas container as set forth in claim 1, wherein the valve member is fitted in a gas passageway of a main valve fixed to the container.

7. A safety gas container as set forth in claim 1, wherein the valve member is fixed to the container by swaging the top and bottom head portions thereof.

8. A safety gas container as set forth in claim 1, wherein the valve member is fitted in a gas passageway produced in the bottom of the container.

* * * * *